United States Patent [19]

Hillier

[11] Patent Number: 4,807,556

[45] Date of Patent: Feb. 28, 1989

[54] RIGID INFLATABLE BOAT

[75] Inventor: Jonathan D. Hillier, London, England

[73] Assignee: Task Force Boats Limited, London, England

[21] Appl. No.: 4,433

[22] Filed: Jan. 20, 1987

[30] Foreign Application Priority Data

Jan. 21, 1986 [GB] United Kingdom ..... 8601401

[51] Int. Cl.[4] ..... B63B 7/00

[52] U.S. Cl. ..... 114/345; 114/123

[58] Field of Search ..... 441/40; 114/343, 345, 114/61, 68, 123, 219, 220, 360, 363

[56] References Cited

U.S. PATENT DOCUMENTS

| | | | |
|---|---|---|---|
| 1,220,876 | 3/1917 | Moore | 114/360 |
| 3,261,038 | 7/1966 | Klepper | 114/345 |
| 3,292,566 | 12/1966 | Russell | 114/219 |
| 4,074,649 | 2/1978 | Stranahan | 114/219 |
| 4,251,893 | 2/1981 | McCrory et al. | 114/345 |
| 4,583,479 | 4/1986 | Lehmann | 114/345 |
| 4,628,854 | 12/1986 | Harding | 114/345 |

FOREIGN PATENT DOCUMENTS

| | | |
|---|---|---|
| 1270938 | 4/1972 | United Kingdom . |
| 1532817 | 11/1978 | United Kingdom . |

*Primary Examiner*—Sherman D. Basinger
*Assistant Examiner*—Stephen P. Avila
*Attorney, Agent, or Firm*—Foley & Lardner, Schwartz, Jeffery, Schwaab, Mack, Blumenthal & Evans

[57] ABSTRACT

A rigid inflatable boat of the kind comprising a hull with an inflatable bouyancy collar, in which the collar comprises a number of separate inflatable members each of which has an axially extending bore so that it may be securely attached to mountings on the hull straps passing through it. Additional mountings may be provided on the deck so that spare inflatable members can be carried on deck for use as seats by the crew. These are used to replace the collar members in the event of accidental damage to them.

18 Claims, 5 Drawing Sheets

RIGID INFLATABLE BOAT

This invention relates to rigid inflatable boats, and particularly to boats of the type including a rigid hull, for example of aluminium, and an inflatable collar or collar assembly which extends around the upper part of the hull.

Conventionally, the collar takes the form of an inflatable tube made of a material such as "Hyperlon" (a type of neoprene) which is fairly strong but has rather poor elasticity. Consequently, the collar may burst when over pressurised, for example as a result of an external impact.

In order to overcome this difficulty, it is known to divide the collar internally into a number of subdivisions, but unfortunately this does not always prevent a number of the internal sections from bursting on impact, owing to the transmission of shocks through the hull structure, or from being partially deflated by reduction of pressure as a result of the impact.

Accordingly, the present invention provides a boat having a rigid hull, and a plurality of separate inflatable members arranged on mountings around the periphery of the hull. Since the inflatable members are separate, the rupture of one does not seriously affect either the pressure in the other members or the load capability safety of the craft. The boat may also include at least one internal mounting for a spare inflatable member, whereby the said spare member can be used as a seat whilst the boat is in normal use.

Preferably, the mountings include a strap or an arrangement of straps, for securing the inflatable members in position.

Some embodiments of the invention will now be described by way of example with reference to the accompanying drawings, in which.

Figure 4A:
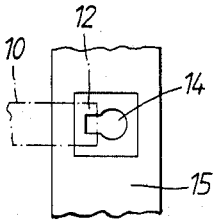
FIG. 4 is a perspective view showing a fender fixed in position on the side of a boat.
Figure 4:
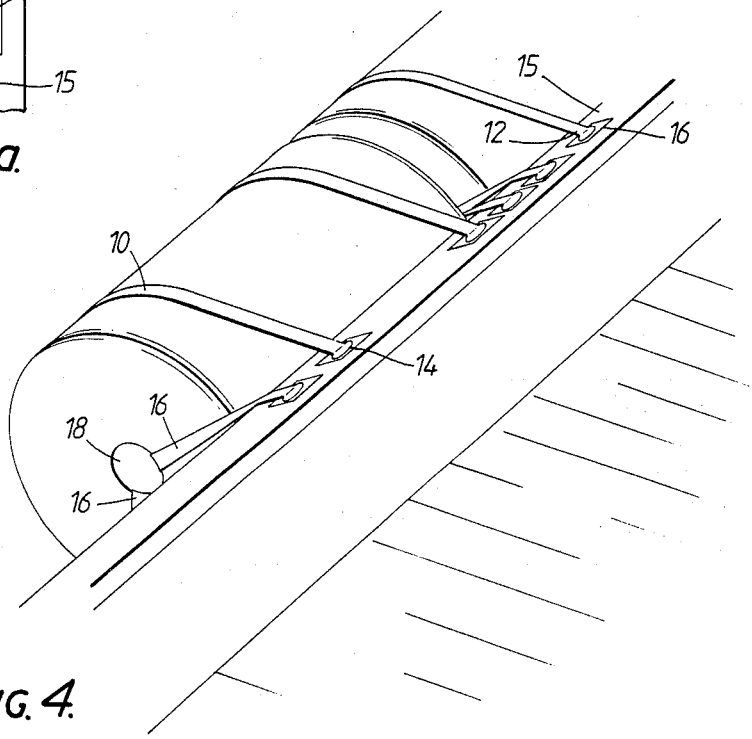
Figure 5:
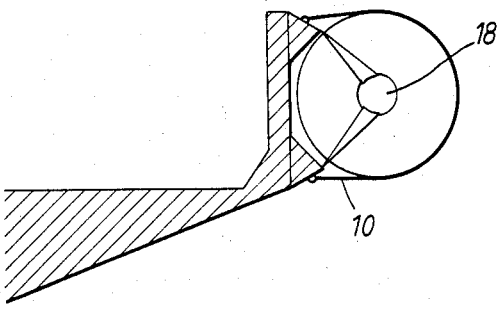
Figure 6:
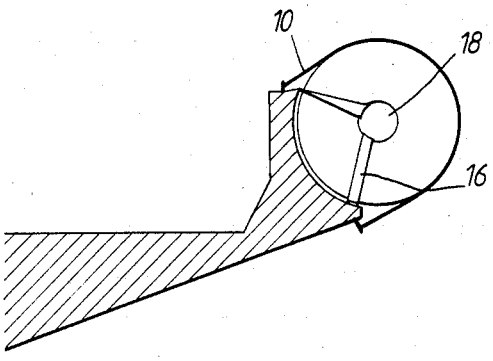
Figure 7:
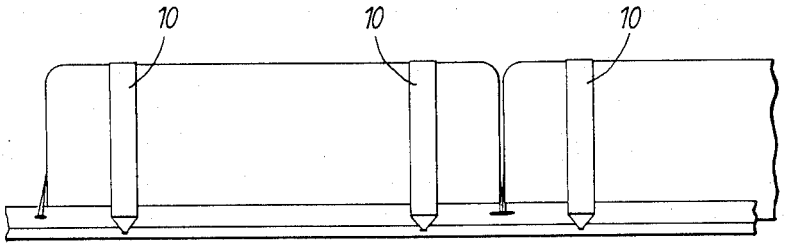
Figure 8A:
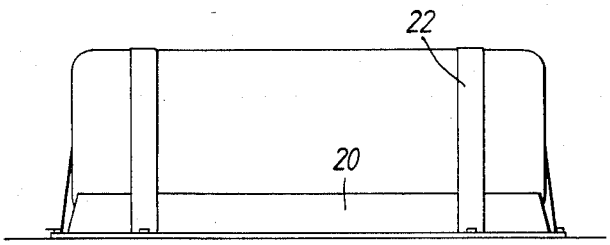
Figure 8B:
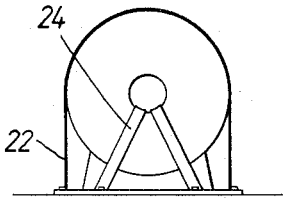
Figure 9A:
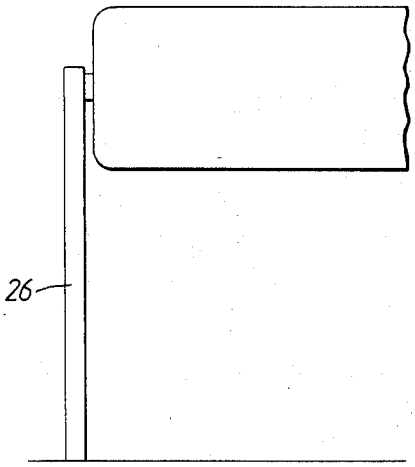
Figure 9B:
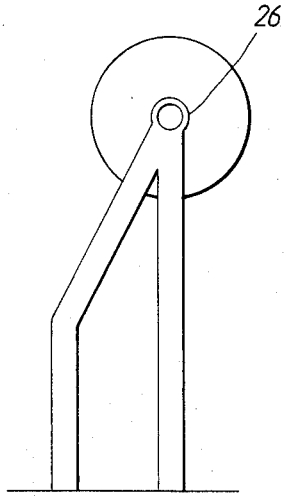

FIG. 4*a* is a partial plan view of the arrangement of FIG. 4;

FIGS. 5 and 6 are partial cross-sections through the side of a boat with fenders attached;

FIG. 7 is a plan view of two fenders in the working position;

FIGS. 8*a* and 8*b* are side and end elevations of spare fenders mounted as seats in the boat; and FIGS. 9*a* and 9*b* are side and end elevations of spare fenders mounted as backrests.

Figure 1:
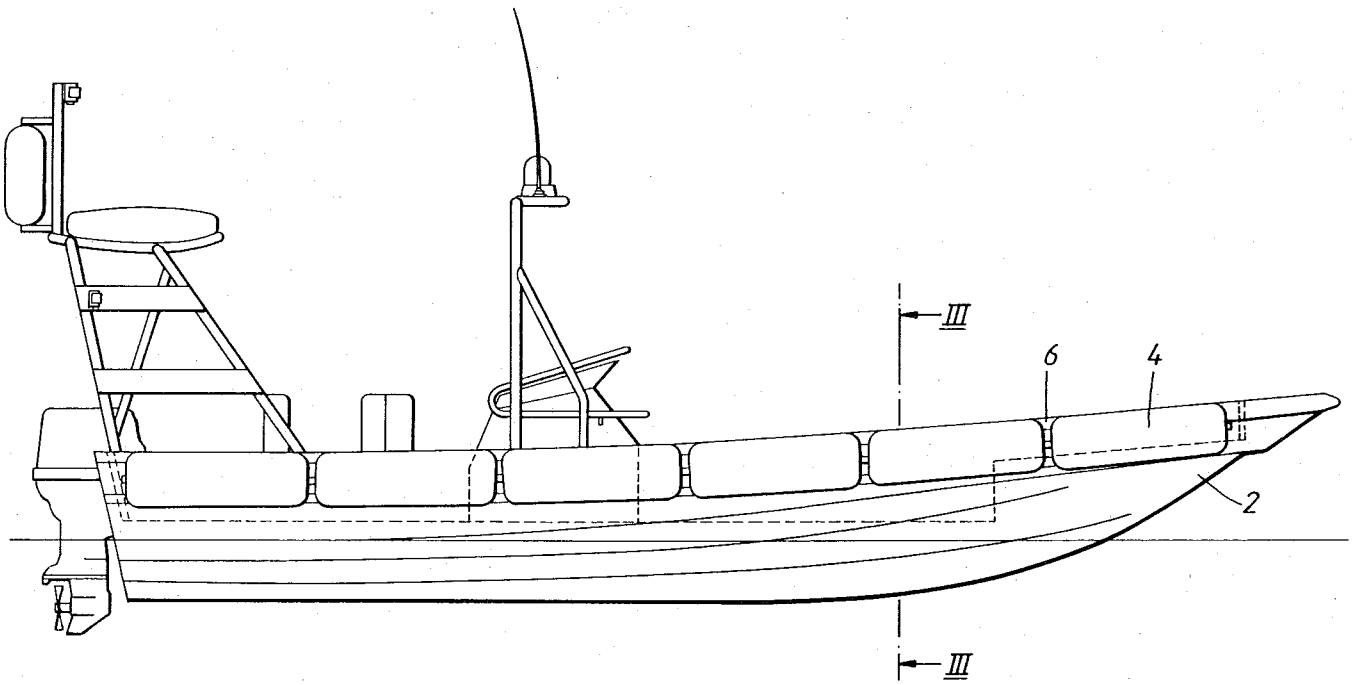
FIG. 1 is a side elevation of a boat in accordance with the invention.
Figure 2:
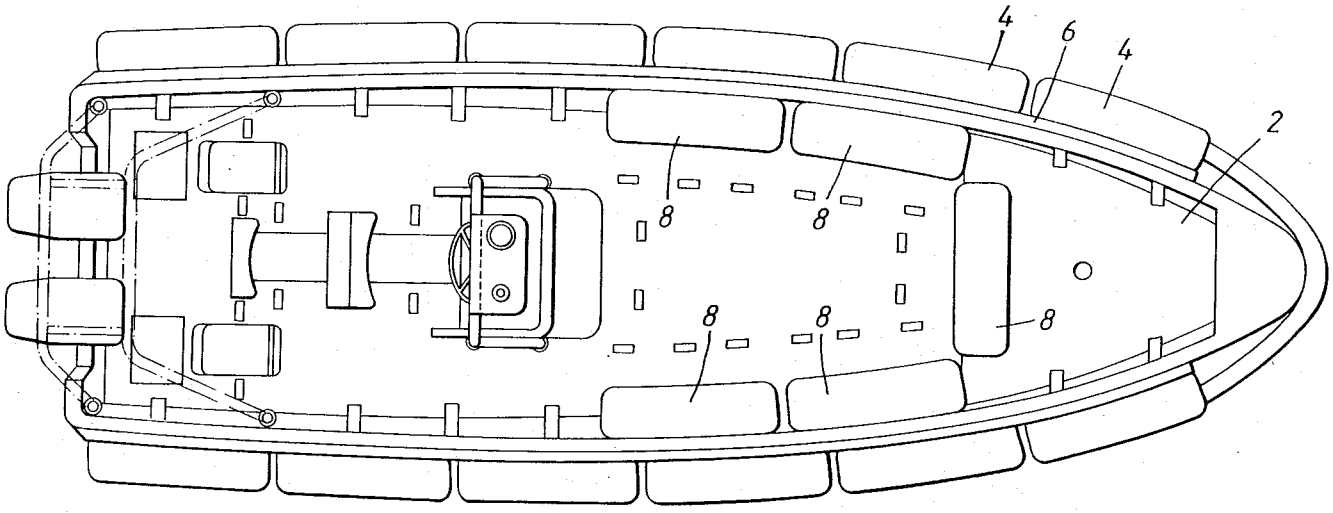
FIG. 2 is a plan view of the boat of FIG. 1.

Referring to the drawings and particularly to FIG. 2, which shows a general plan view of the boat, it will be seen that the rigid hull 2 is provided with a fender mounting which extends around the upper edge of the hull, and has a number of inflatable pneumatic fenders 4 attached to it.

Each of the pneumatic fenders comprises a generally cylindrical inflatable member made of moulded PVC, which has excellent elasticity and is thus less susceptible to impact damage than conventional materials.

Figure 3:
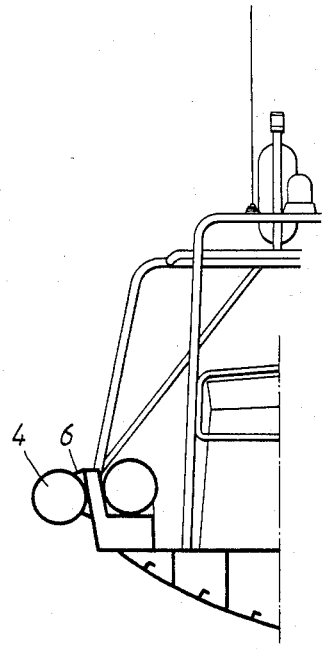
FIG. 3 is a partial vertical cross-section taken on the line III—III of FIG. 1.

As shown in FIG. 3, the inflatable members are located in channel like formations 6, which extend around the edge of the hull, and retained in position by straps which extend around the body of each inflatable member. Each strap may be provided with a key-like member or stud at each end which can fit into a keyhole-like aperture in the hull. The strap is made relatively short so that it can be easily connected around the inflatable member while it is semi-inflated, and each stud inserted in the enlarged entry of its corresponding aperture. Thus when the member is fully inflated the keys are pulled further into their apertures, locking the assembly in position.

Each inflatable member is also provided with an axially extending bore, and a strap or a pair of straps is threaded through the axial bore of each member, and connected to the hull in the same way.

FIG. 4 shows a generally perspective view of a fender strapped onto the side of a boat, with circumferentially extending straps 10 of strong webbing having their ends 12 located in slots 14 on the side 15 of the boat. The fender is preferably provided with circumferential recesses or grooves (not shown) to locate the straps in position. A further pair of straps 16 is passed through an axial bore 18 in the fender and the ends are similarly secured. The slots 14 are preferably keyhole-shaped as shown in the detailed view of FIG. 4*a*, so that studs fixed to the ends 12 of the straps 10 will be locked in position when the fenders are fully inflated. Alternatively any other suitable type of fastener may be used to lock the straps in position, for example one of the many well-known types of releasable fasteners designed for use on boats and/or aircraft.

As shown in FIGS. 5 and 6, the locating channels for the fenders may be arranged so that the fenders are supported completely from one side (FIG. 5) or partly from beneath (FIG. 6). FIGS. 8*a* and 8*b* show how spare fenders may be mounted in the boat as seats, on shaped bases, and again held in position by circumferential straps 22 and longitudinal straps 24. Alternatively they may be mounted on strong tube frameworks 26, FIG. 9, passing through the longitudinal bores, so as to act as backrests.

What is claimed is:

1. A boat comprising:

a rigid hull;

a plurality of separate, generally tubular, inflatable buoyancy members adapted to be attached around the exterior of the hull; and first mounting means for said inflatable members, said first mounting means including: means for independently mounting each respective inflatable member to the hull, comprising:

first strap means comprising at least one strap extending circumferentially around each inflatable member;

an axially extending bore in each said inflatable member;

second strap means comprising at least one separate strap extending through said bore of each inflatable member; and fastener means for each end of each strap, said fastener means comprising co-operating parts arranged respectively on said end of said strap and on the exterior of the hull, and whereby for ease of separate replacement, each inflatable member can be positioned on the hull in a semi-inflated condition and then fully inflated so as to be tightly held in position by the straps.

2. A boat according to claim 1, in which the said first mounting means further comprises locating channel means extending circumferentially around the said hull at or above the water level.

3. A boat according to claim 1, further comprising deck means;

and at least one second mounting means arranged on said deck means, whereby a spare inflatable member may be carried on said second mounting means to form a seat.

4. A boat according to claim 3, in which said second mounting means includes first strap means comprising at least one strap extending circumferentially around each spare inflatable member;

an axially extending bore in said spare inflatable member;

second strap means comprising at least one strap extending through said bore of each said inflatable member;

and fastener means for each end of each strap, said fastener means comprising co-operating members arranged respectively on the said end of the strap and on the deck whereby the spare inflatable member can be positioned on the hull in a semi-inflated condition and then fully inflated so as to be tightly held in position by the straps.

5. A boat according to claim 4, in which said second mounting means further comprises locating channel means on said deck.

6. A boat according to claim 4, in which said second strap means comprises a pair of straps, the corresponding ends of the two straps of the said pair being attached to the deck at positions which are spaced apart horizontally on the deck, whereby the spare inflatable member is securely located against lateral movement on the deck.

7. A boat according to claim 1 further comprising deck means;

and rigid framework means mounted on said deck for supporting at least one inflatable member;

said framework means including at least one horizontally extending member adapted to pass through the axially-extending bore of said member so that said member may be mounted thereon.

8. A boat according to claim 2 in which each said second strap means comprises a pair of straps, the corresponding ends of the two straps of the said pair being attached to the hull at positions which are vertically spaced apart on the hull, whereby each inflatable member is securely located against vertical movement.

9. A boat according to claim 5 in which said second strap means comprises a pair of straps, the corresponding ends of the two straps of the said pair being attached to the deck at positions which are spaced apart horizontally on the deck, whereby the spare inflatable member is securely located against lateral movement on the deck.

10. A boat according to claim 1, wherein said boat comprises a plurality of said inflatable buoyancy members along each side thereof.

11. A boat according to claim 3, where said spare inflatable member has the same size and configuration as said inflatable members attached around the exterior of the boat.

12. A boat according to claim 1, wherein said fastening means include means for fully engaging said cooperating parts upon inflation of said inflatable member.

13. A boat comprising:

a rigid hull;

a plurality of separate, generally tubular, inflatable buoyancy members adapted to be attached around the exterior of the hull;

and first mounting means for the said inflatable members; the said first mounting means including:

first strap means comprising at least one strap extending circumferentially around each inflatable member;

an axially extending bore in each said inflatable member;

second strap means comprising at least one strap extending through said bore of each said inflatable member;

and fastener means for each end of each strap, said fastener means comprising co-operating parts arranged respectively on the said end of the strap and on the exterior of the hull, whereby the inflatable member can be positioned on the hull in a semi-inflated condition and then fully inflated so as to be tightly held in position by the straps wherein each said second strap means comprises a pair of straps, the corresponding ends of the two straps of the said pair being attached to the hull at positions which are vertically spaced apart on the hull, whereby each inflatable member is securely located against vertical movement.

14. A boat comprising:

a rigid hull;

a plurality of separate, generally tubular, inflatable members adapted to be attached to the exterior of the hull;

each inflatable member having means for mounting the inflatable member to the hull, comprising:

first mounting means including an axially extending bore in each said inflatable member;

strap means comprising a pair of straps extending through said bore, and fastener means having co-pending parts arranged respectively on each end of each strap, and on the exterior of the hull, the corresponding ends of each of said pair of straps being attached to the hull at vertically spaced positions, whereby each inflatable member is secured against vertical movement.

15. A boat according to claim 14, further comprising deck means;

and at least one second mounting means arranged on said deck means, whereby an inflatable member may be carried on said second mounting means to form a seat;

said second mounting means comprising an axially-extending bore in said member, strap means comprising at least one strap extending through said bore, and fastener means having cooperating parts on said strap and said deck, whereby said inflatable member may be securely located against lateral movement on said deck.

16. A boat according to claim 15, in which said strap means comprises a pair of straps, said deck fastener means being spaced apart on said deck at each end of said mounting means.

17. A boat comprising:

a rigid hull;

a plurality of separate, generally tubular, inflatable buoyancy members having an outer circumferential surface and opposed ends and adapted to be attached around the exterior of the hull; and mounting means for said inflatable members, said mounting means being means for independently mounting each respective inflatable member to the hull, including:

first strap means comprising at least one strap extending around said circumferential surface of each inflatable member;

second strap means comprising at least one separate strap extending from each opposed end of said inflatable member; and fastener means for each end of each strap, said fastener means comprising co-operating parts arranged respectively ons aid end of said strap and on the exterior of the hull, and whereby for ease of separate replacement, each inflatable member can be positioned on the hull in a semi-inflated condition and then fully inflated so as to be tightly held in position by the straps.

18. A boat according to claim 17, wherein at least one of said first and second strap means is attached to the hull at positions which are vertically spaced apart on the hull for securing each inflatable member against vertical movement.

* * * * *